US009552907B2

(12) United States Patent
Emilsson et al.

(10) Patent No.: US 9,552,907 B2
(45) Date of Patent: Jan. 24, 2017

(54) CONDENSER CORE

(71) Applicant: ABB Schweiz AG, Baden (CH)

(72) Inventors: David Emilsson, Ludvika (SE); Lina Bjelkenas, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/109,003

(22) PCT Filed: Jan. 21, 2015

(86) PCT No.: PCT/EP2015/051106

§ 371 (c)(1),
(2) Date: Jun. 29, 2016

(87) PCT Pub. No.: WO2015/117823

PCT Pub. Date: Aug. 13, 2015

(65) Prior Publication Data

US 2016/0329134 A1 Nov. 10, 2016

(30) Foreign Application Priority Data

Feb. 5, 2014 (SE) ..... 1400056

(51) Int. Cl.
*H01B 17/58* (2006.01)

(52) U.S. Cl.
CPC ..... *H01B 17/583* (2013.01)

(58) Field of Classification Search
USPC ..... 174/143
See application file for complete search history.

(56) References Cited

U.S. PATENT DOCUMENTS 3,277,423 A * 10/1966 Rose ..... H01B 17/306 174/143
3,340,117 A * 9/1967 Inoue ..... H01B 17/26 156/184

FOREIGN PATENT DOCUMENTS

| | | | |
|---|---|---|---|
| AU | 2009200951 | A1 | 10/2009 |
| EP | 339667 | A | 12/1930 |
| EP | 1103988 | A2 | 5/2001 |
| WO | 2006001724 | A1 | 1/2006 |

OTHER PUBLICATIONS

International Preliminary Report on Patentability Application No. PCT/EP2014/051106 Completed: Mar. 8, 2016 6 pages.

(Continued)

*Primary Examiner* — Dhirubhai R Patel
(74) *Attorney, Agent, or Firm* — Whitmyer IP Group LLC

(57) ABSTRACT

A resin impregnated paper (RIP) condenser core configured for being positioned around an electrical conductor. The condenser core includes a winding tube forming a longitudinal through hole through the condenser core, configured for allowing an electrical conductor to be inserted there through; an electrically insulating RIP body wound onto and around the winding tube; and at least one electrically conducting foil coaxially encircling the winding tube and being surrounded by the RIP body insulating each of the at least one foil from any other of the at least one foil. The winding tube is of an electrically insulating material which has been chosen from a group consisting of materials having a volumetric thermal expansion coefficient within the range of 50% to 200% of the volumetric thermal expansion coefficient of the RIP body.

19 Claims, 1 Drawing Sheet

(56) References Cited

OTHER PUBLICATIONS

International Search Report and Written opinion of the International Searching Auhtority Application No. PCT/EP2014/051106 Completed: Mar. 10, 2015; Mailing Date: Mar. 19, 2016 8 pages.
Written Opinion of the International Preliminary Examining Authority Application No. PCT/EP2014/051106 Mailing Date: Dec. 12, 2015 5 pages.

* cited by examiner

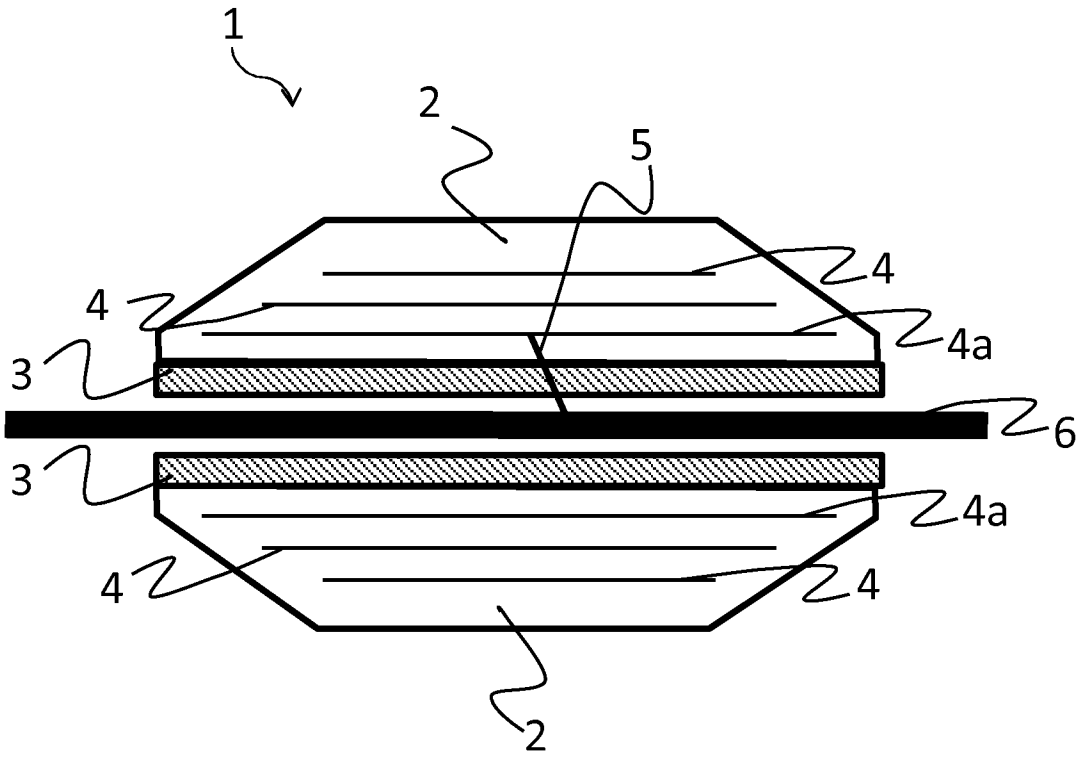
1
2
5
4
4a
6
4a
4
2
4
3
3
4

CONDENSER CORE

TECHNICAL FIELD

The present disclosure relates to a condenser core wound onto a winding tube and configured for being positioned around an electrical conductor.

BACKGROUND

High voltage bushings are used for carrying current at high potential through a plane, often referred to as a grounded plane, where the plane is at a different potential than the current path. High voltage bushings are designed to electrically insulate a high voltage conductor, located inside the bushing, from the grounded plane. The grounded plane can for example be a transformer tank or a wall.

In order to obtain a smoothening of the electrical potential distribution between the conductor and the grounded plane, a bushing often comprises a number of floating, coaxial foils made of a conducting material and coaxially surrounding the high voltage conductor, the coaxial foils forming a so called condenser core. The foils could for example be made of aluminium, and are typically separated by a dielectric insulating material, such as for example oil impregnated paper (OIP) or resin impregnated paper (RIP). The coaxial foils serve to smoothen the electric field distribution between the outside of the bushing and the inner high voltage conductor, thus reducing the local field enhancement. The coaxial foils help to form a more homogeneous electric field, and thereby reduce the risk for electric breakdown and subsequent thermal damage. OIP is used with oil-filled bushings, while RIP is used in dry-type bushings.

An RIP condenser core is produced by winding paper sheets in concentrical layers and positioning aluminium foils between some of the paper sheets such that the foils are insulated from each other. Under vacuum, epoxy resin is impregnated into the dry layers of wound paper, after which the resin is cured to produce the RIP core.

Some RIP condenser cores, are wound directly on the conductor. A potential connection is made between the conductor and the innermost foil in the core in order to achieve an environment within the innermost foil which is free of an electrical field. However, it may practical to be able to exchange the conductor, e.g. chose between a cupper or an aluminium conductor why a condenser core which is produced separate from the conductor and allows the conductor to be introduced through the core may be desired. This can be achieved by winding the core on a mandrel which is then removed to provide a longitudinal through hole in the core through which the conductor can be introduced. However, especially for larger cores, it may be difficult to remove the mandrel after winding due to shrinkage of the core during manufacture, which clamps the core to the mandrel. Another possibility is to wind the condenser core on a metal winding tube, usually of thin aluminium or copper. A reason for using a winding tube of a conducting metal is to be able to easily have a potential connection between the conductor/winding tube and the innermost foil in the condenser core. The winding tube remains in the core and provides the longitudinal through hole through which the conductor is inserted.

In an RIP condenser core with a winding tube, the thermal expansion coefficient of the RIP is in the order of three to five times higher than that of the aluminium or copper of the winding tube. Since the cross section area of the RIP in the core is significantly larger than that of the winding tube, the RIP will govern the thermal expansion of the core. This result in either the metal winding tube being delaminated from the RIP material or in high mechanical tension stresses in the winding tube. The RIP core may be designed such that the core is supposed to stick to the winding tube at one position whilst the rest is supposed to be able to separate from the winding tube during expansion of the RIP (by the use of e.g. cork, rubber and sealing). Occasionally the RIP core sticks to the winding tube anyway, which can destroy the winding tube.

SUMMARY

It has now been realised that the problems with different thermal expansion of the winding tube as compared with the RIP in the condenser core can be alleviated by using a winding tube made from a material which has a thermal expansion coefficient similar to that of the RIP. The winding tube may thus not be of a conducting metal, but instead of e.g. RIP, paper or another fibre composite material. If an electrical potential connection with an electrically conducting foil in the condenser core is still needed, a passage for an electrical connection, e.g. an aluminium or copper thread, with the foil may be provided through the winding tube for connecting with conductor after it has been inserted through the condenser core.

According to an aspect of the present invention, there is provided a condenser core configured for being positioned around an electrical conductor. The condenser core comprises a winding tube forming a longitudinal through hole through the condenser core, configured for allowing an electrical conductor to be inserted there through; an electrically insulating body wound onto and around the winding tube; and at least one electrically conducting foil coaxially encircling the winding tube and being surrounded by the body insulating each of the at least one foil from any other of the at least one foil. The winding tube is of an electrically insulating material which has been chosen from a group consisting of materials having a volumetric thermal expansion coefficient within the range of 50% to 200%, e.g. 80% to 125%, of the volumetric thermal expansion coefficient of the body.

According to another aspect of the present invention, there is provided a method of producing a condenser core configured for being positioned around an electrical conductor. The method comprises winding sheets of an insulating material, with intermediate electrically conducting foils, onto and around a winding tube, to form an electrically insulating body surrounding the foils coaxially encircling the winding tube; and impregnating the electrically insulating body with a resin to form the condenser core having a composite body. The winding tube is of an electrically insulating material which has been chosen from a group consisting of materials having a volumetric thermal expansion coefficient within the range of 50% to 200%, e.g. 80% to 125%, of the volumetric thermal expansion coefficient of the body.

By means of embodiments of the present invention, a cheap and simple condenser core is provided with reduced risk of problems due to deviating thermal expansion of the body and the winding tube.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise.

BRIEF DESCRIPTION OF THE DRAWINGS

Embodiments will be described, by way of example, with reference to the accompanying drawing, in which:

FIG. 1 is a schematic longitudinal section of an embodiment of a condenser core in accordance with the present invention.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

FIG. 1 is a longitudinal section of an embodiment of a condenser core 1 of the present invention, positioned around an electrical conductor 6. The condenser core 1 comprises a body 2 wound onto a winding tube 3 providing a longitudinal through hole through the condenser core 1. The body may be of any material, e.g. epoxy impregnated paper. The body 2 surrounds a plurality of electrically conducting foils 4 which are concentrically encircling the winding tube 3. The foils 4 are insulated from each other, as well as from the exterior of the condenser core 1, by the insulating body 2 within which the foils 4 are positioned. Typically, the innermost foil 4*a* is also spaced from the winding tube 3 by means of the body 2. Any or all of the foils 4 may be of any suitable conductive material, e.g. aluminium or copper. In accordance with the present invention, the winding tube 3 is of an electrically insulating material which has a thermal expansion behaviour which is of the same order as the thermal expansion behaviour of the material of the body 2, i.e. the material of the winding tube has a thermal expansion coefficient which is similar to the thermal expansion coefficient of the body material. If desired, in order to reduce or eliminate the electrical field inside of the innermost foil 4*a*, a potential connection 5, possibly only one connection 5 per condenser core 1, may be provided, configured to electrically connect the innermost foil 4*a* with the conductor 6 when the conductor is inserted through the condenser core 1. The connection 5 may e.g. be by means of an electrically conducting thread 5 made of e.g. aluminium or copper. The connection 5 may e.g. run through a passage or hole through the wall of the winding tube 3. The end of the connection 5 within the winding tube 3 may be provided with a suitable contact or fastening means for contacting or fastening to the conductor 6 when it has been introduced through the longitudinal through hole through the condenser core 1 provided by the winding tube 3. With the exception of the electrical potential connection 5, the condenser core 1 may typically be essentially rotation symmetrical.

The volumetric thermal expansion coefficient $\alpha$ can be calculated as follows:

$$\alpha_V = \frac{1}{V}\left(\frac{\partial V}{\partial T}\right)_p$$

In which V is the volume, T is the temperature, the subscript p indicates that the pressure is held constant during the expansion, and the subscript V stresses that it is the volumetric (not linear) expansion which is calculated.

In accordance with the present invention, the winding tube 3 is of an electrically insulating material which has a thermal expansion behaviour which is of the same order as the thermal expansion behaviour of the material of the body 2, i.e. the material of the winding tube has a thermal expansion coefficient which is similar to the thermal expansion coefficient of the body material. For instance, the winding tube 3 is of an electrically insulating material which has been chosen from a group consisting of materials having a volumetric thermal expansion coefficient within the range of 50% to 200%, e.g. 80% to 125%, of the volumetric thermal expansion coefficient of the body 2. Thereby, the problems associated with different thermal expansion of the winding tube 3 and the body are reduced.

Examples of such suitable materials for the winding tube includes e.g. resin impregnated paper (RIP), possibly the same type of material as in the body 2 or another material, e.g. epoxy impregnated paper. Alternatively, non-impregnated paper may be used for the winding tube. Such paper may then be impregnated together with the body 2 during manufacture of the condenser core 1, to become essentially the same RIP material as in the body 2. Also other fibre composite materials may be suitable, e.g. glass fibre and resin composite materials, for the winding tube 3. Thus, in some embodiments of the present invention, the winding tube 3 is made of RIP, paper or an other fibre composite material. In some embodiments, the winding tube 3 is made of epoxy impregnated paper. A person skilled in the art, may be able to find additional suitable materials for the winding tube 3 by experimentation for observing the thermal expansion of considered materials at different temperatures and compare it with the corresponding thermal expansion of the material of the body 2.

In some embodiments of the present invention, the condenser core 1 comprises an electrical connection, e.g. an electrically conducting thread, between at least one of the foils 4, e.g. the innermost foil 4*a*, possibly through the winding tube 3, and configured to contact the conductor 6 when inserted through the winding tube 4, to provide an electrical connection between the at least one of the foils 4 and the conductor 6.

In some embodiments of the present invention, the condenser core is configured for a high voltage electrical conductor 6, e.g. of at least 1000 volts such as of at least 10000 volts or at least 35000 volts.

In some embodiments of the present invention, the RIP body 2 is made of epoxy impregnated paper.

The material of the body 2, may be any suitable electrically insulating material, e.g. a composite material such as RIP or resin impregnated synthetics (RIS), where the major insulation body consists of a core wound from synthetic fibre, subsequently impregnated with a curable resin, where the synthetic fibre can be a polymeric fibre mesh e.g. polyester fibre mesh.

The material of the body 2, may also be a resin impregnated non-woven fibre material such as a non-woven polymeric fibre e.g. non-woven polyester fibre, or a plastic body e.g. made of wound plastic material, and including the conducting foils 4. The resin with which the body may be impregnated may e.g. be an thermosetting resin such as epoxy or a thermoplastic material, such as PET or PP (Poly Ethylene Terephthalate, Poly Propylene).

The condenser core of the present invention may be produced by winding paper onto the winding tube 3, followed by impregnation with a resin, e.g. an epoxy resin, and possibly curing of the resin to form the condenser core 1. Thus, sheets of paper, with intermediate electrically conducting foils 4, are wound onto and around the winding tube 3, to form an electrically insulating body 2 surrounding the foils 4, which foils 4 are coaxially encircling the winding tube 3. Then, the electrically insulating body 2 is impregnated, possibly under vacuum, with a resin to form the condenser core 1. The condenser core 1 will then have an RIP body 2. If the winding tube 3 is of paper or another non-impregnated fibre material, also the winding tube may be impregnated with the resin during the same process as the body 2 is impregnated with the resin, e.g. epoxy. Depending on the resin used, the resin of the impregnated condenser core 1 may then be cured. Optionally, the condenser core 1 may be machined after production, e.g. lathed, to a desired shape for e.g. a bushing.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A condenser core assembly, comprising:

an electrical conductor;

a winding tube having a hole allowing the electrical conductor to be inserted there through;

an electrically insulating body wound onto and around the winding tube; and a plurality of electrically conducting foils coaxially encircling the winding tube and each of the plurality of conducting foils being surrounded by the insulating body;

wherein the winding tube is made from an electrically insulating material; and wherein the condenser core comprises an electrical connection contacting at least one of the plurality of conductive foils and being configured to contact the conductor when the conductor is inserted through the winding tube.

2. The condenser core assembly of claim 1, wherein the electrically insulating material of the winding tube has been chosen from a group consisting of materials having a volumetric thermal expansion coefficient within the range of 50 to 200 percentage of a volumetric thermal expansion coefficient of the body.

3. The condenser core of claim 2, wherein the electrically insulating material of the winding tube has been chosen from a group consisting of materials having a volumetric thermal expansion coefficient within the range of 80 percentage to 125 percentage of the volumetric thermal expansion coefficient of the body.

4. The condenser core assembly of claim 1, wherein the winding tube is made of resin impregnated paper, resin impregnated synthetics, paper or a fibre composite material.

5. The condenser core assembly of claim 4, wherein the winding tube is made of epoxy impregnated paper.

6. The condenser core assembly of claim 1, wherein the electrical connection comprises an electrically conducting thread contacting the at least one of the plurality of foils and being configured to contact the conductor when the conductor is inserted through the winding tube.

7. The condenser core assembly of claim 1, wherein the electrical connection passes through the winding tube.

8. The condenser core assembly of claim 1, wherein the body is a resin impregnated paper or a resin impregnated synthetics body.

9. The condenser core assembly of claim 1, wherein the condenser core is configured for a high voltage electrical conductor of at least 1000 volts.

10. The condenser core assembly of claim 9, wherein the condenser core is configured for a high voltage electrical conductor of at least 10,000 volts.

11. The condenser core assembly of claim 9, wherein the condenser core is configured for a high voltage electrical conductor of at least 35,000 volts.

12. The condenser core assembly of claim 1, wherein the body is made of epoxy impregnated paper.

13. A method of producing a condenser core assembly having an electrical conductor, the method comprising:

winding sheets of an insulating material, with intermediate electrically conducting foils, onto and around a winding tube, to form an electrically insulating body surrounding the foils coaxially encircling the winding tube; and impregnating the electrically insulating body with a resin to form the condenser core having a composite body;

wherein the winding tube is made from an electrically insulating material; and wherein the condenser core comprises an electrical connection contacting at least one of the foils and being configured to contact the conductor when the conductor is inserted through the winding tube.

14. The method of claim 13, wherein the electrically insulating material of the winding tube has been chosen from a group consisting of materials having a volumetric thermal expansion coefficient within the range of 50 percentage to 200 percentage of a volumetric thermal expansion coefficient of the body.

15. The method of claim 14, wherein the electrically insulating material of the winding tube has been chosen from a group consisting of materials having a volumetric thermal expansion coefficient within the range of 80 percentage to 125 percentage of the volumetric thermal expansion coefficient of the body.

16. The method of claim 13, wherein the impregnating also comprises impregnating the winding tube with the resin.

17. The method of claim 13, further comprising:

curing the resin after the impregnating.

18. The method of claim 13, wherein the winding comprises winding sheets of the insulating material onto and around the winding tube made of resin impregnated paper, resin impregnated synthetics, paper or a fibre composite material.

19. The method of claim 13, wherein the insulating material is a fibre material such as paper or a synthetic fibre material.

* * * * *